US010822782B2

(12) United States Patent
El Halabi Sirdar et al.

(10) Patent No.: US 10,822,782 B2
(45) **Date of Patent: *Nov. 3, 2020**

(54) DEVICE FOR ADAPTING A FLAPPER OF A FLUSH VALVE OF A TOILET TANK TO A VALVE BASE WITH A LATERAL OVERFLOW PIPE

(71) Applicant: H & H Idrospania Technic, S.L., Burriana (ES)

(72) Inventors: Naji El Halabi Sirdar, Burriana (ES); José Mario Quesada Martinez, Burriana (ES)

(73) Assignee: H & H Idrospania Technic, S.L., Burriana (ES)

( * ) Notice: Subject to any disclaimer, the term of this patent is extended or adjusted under 35 U.S.C. 154(b) by 0 days.

This patent is subject to a terminal disclaimer.

(21) Appl. No.: 16/275,584

(22) Filed: Feb. 14, 2019

(65) Prior Publication Data

US 2020/0263404 A1 Aug. 20, 2020

(51) Int. Cl.
*E03D 1/34* (2006.01)

(52) U.S. Cl.
CPC ..... *E03D 1/34* (2013.01)

(58) Field of Classification Search
CPC ..... E03D 1/34
USPC ..... 4/393
See application file for complete search history.

(56) References Cited

U.S. PATENT DOCUMENTS

| | | | | |
|---|---|---|---|---|
| 4,698,859 A * | 10/1987 | Freed | E03D 1/34 | 4/382 |
| 8,230,532 B2 * | 7/2012 | Htay | E03D 1/306 | 4/392 |
| 2008/0134422 A1 * | 6/2008 | Nichols-Roy | E03D 1/308 | 4/393 |
| 2009/0144888 A1 * | 6/2009 | Han | E03D 1/306 | 4/393 |

* cited by examiner

*Primary Examiner* — Lori L Baker
(74) *Attorney, Agent, or Firm* — Richard M. Goldberg

(57) ABSTRACT

A device for adapting a flapper of a flush valve of a toilet tank to a valve base with a lateral overflow pipe, includes a fastening element for fastening to the lateral overflow pipe, which has a ring or cylinder shape with a low height and which includes a pair of recesses able to house lugs arranged in the lateral overflow pipe, and which further includes a pair of lugs arranged in opposite positions in a section of the fastening element; and a flapper made up of a flapper body and a pair of arms arranged in the upper portion of the flapper body, the end of each arm including a housing adapted to house the lugs of the fastening part.

4 Claims, 3 Drawing Sheets

DEVICE FOR ADAPTING A FLAPPER OF A FLUSH VALVE OF A TOILET TANK TO A VALVE BASE WITH A LATERAL OVERFLOW PIPE

BACKGROUND OF THE INVENTION

The present invention relates to a device for adapting a flapper of a flush valve of a toilet tank to a valve base with a lateral overflow pipe which enables the adaptation of a flapper regardless of the size of the lateral overflow pipe.

STATE OF THE ART

The flush valves whereon the device object of the present invention is installed are made up of a valve base which is housed in the flush hole of the tank and is fastened thereto, said base defining a flush conduit through which the water passes during the emptying of the tank. This valve base further comprises a flapper which blocks said flush conduit. The flapper is articulated in an overflow pipe, arranged on one side of the valve base, the vertical axis of the overflow pipe being eccentric to the vertical axis of the flush conduit defined by the valve base. The lower end of the overflow pipe connects to the flush conduit in a portion lower than the portion wherein the flapper is arranged. When said flapper is pulled by means of a chain joined to an actuation mechanism (usually a lever, pull element, button, etc.), the valve opens and the emptying of the tank is enabled.

When the flapper is to be exchanged for another new one, normally due to the deterioration thereof, there is the problem that, depending on the diameter of the lateral overflow pipe, and the position and size of the articulation means, a specific flapper must be found for that valve base.

Due to this type of flushers being substituted by more complex flushing mechanisms which enable the flush volume to be regulated, it is possible that the flapper necessary for the valve base whereon it is to be installed may not be found, since it may not be manufactured anymore. The substitution of the complete body furthermore requires the disassembly of the tank and on occasion also that of the toilet, which implies a job with a high degree of specialization and longer time employed.

In order to solve the mentioned problem, the present invention provides a device for adapting a flapper of a flush valve of a toilet tank to a valve base with a lateral overflow pipe, which enables a flapper to be installed in valve bases provided with a lateral overflow pipe, regardless of the diameter of the lateral overflow pipe or the size of the articulation elements of the flapper arranged in said lateral overflow pipe.

SUMMARY OF THE INVENTION

The present invention provides a device for adapting a flapper of a flush valve of a toilet tank to a valve base with a lateral overflow pipe, like the ones described previously.

The device for adapting a flapper of a flush valve of a toilet tank to a valve base with a lateral overflow pipe mainly comprises two elements.

The first element is an element for fastening to the lateral overflow pipe of the valve base. Said element has a ring or cylinder shape with a low height, between 0.5 and 3 cm, and is inserted from the upper portion of the overflow pipe. The fastening element is inserted on the overflow pipe using pressure. The element for fastening to the lateral overflow pipe comprises a pair of lugs in opposite positions in a section of said fastening element. If the inner diameter of the fastening element is significantly greater than the outer diameter of the overflow pipe, an accessory element can be added which is arranged on the inner face of the fastening element and adapts the inner diameter of the assembly of the fastening element and accessory to the outer diameter of the overflow pipe. According to an optional embodiment, the fastening element further comprises a pair of grooves in correspondence with a pair of lugs arranged in the overflow pipe used as an articulation element of the flapper in the simple flush valves whereon the device object of the present invention is installed.

The other element is a flapper of the conduit defined by the valve base, made up of a flapper body and a pair of arms arranged in the upper portion of said flapper body, the end of each arm comprising a housing able to house the lugs of the fastening part, whereon the flapper is articulated when a chain joined to the upper portion of the flapper body is pulled.

BRIEF DESCRIPTION OF THE DRAWINGS

With the aim of illustrating the explanation that follows, we have attached three sheets of drawings to the present specification wherein four figures represent, by way of example and without limiting character, the present invention according to a particular embodiment, and wherein.

Figure 1:
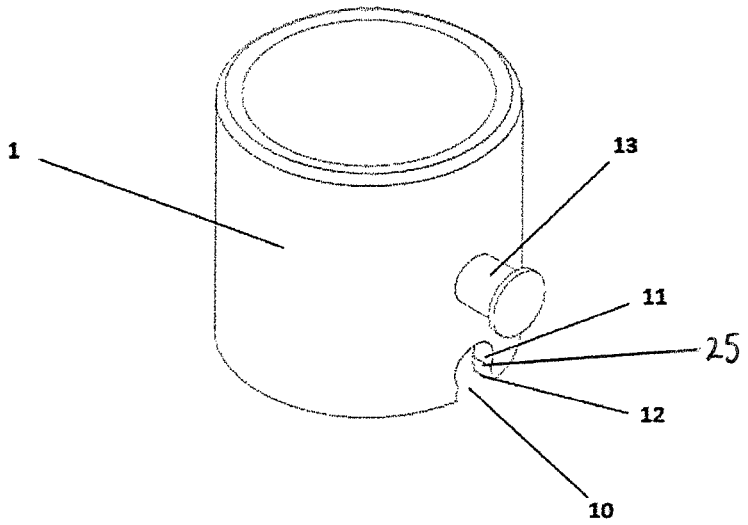
FIG. 1 shows a perspective view of the fastening element of the device for adapting a flapper of a flush valve of a toilet tank to a valve base with a lateral overflow pipe, according to an embodiment of the present invention.

In said figures we can see the following reference signs:

1 Element for fastening to the lateral overflow pipe.
10 Recess of the element for fastening to the lateral overflow pipe
11 Housing of the lugs of the lateral overflow pipe
12 Mouth of the recess of the element for fastening to the lateral overflow pipe
13 Lugs of the element for fastening to the lateral overflow pipe
2 Flapper
20 Body of the flapper
21 Arms of the flapper
22 Housings of the lugs of the element for fastening to the lateral overflow pipe
3 lateral overflow pipe
4 Lugs of the lateral overflow pipe

DETAILED DESCRIPTION OF A PREFERRED EMBODIMENT OF THE INVENTION

In view of the aforementioned figures and, in accordance with the numbering adopted, an example of a preferred embodiment of the invention can be observed therein, which comprises the parts and elements indicated and described in detail below.

Figure 2:
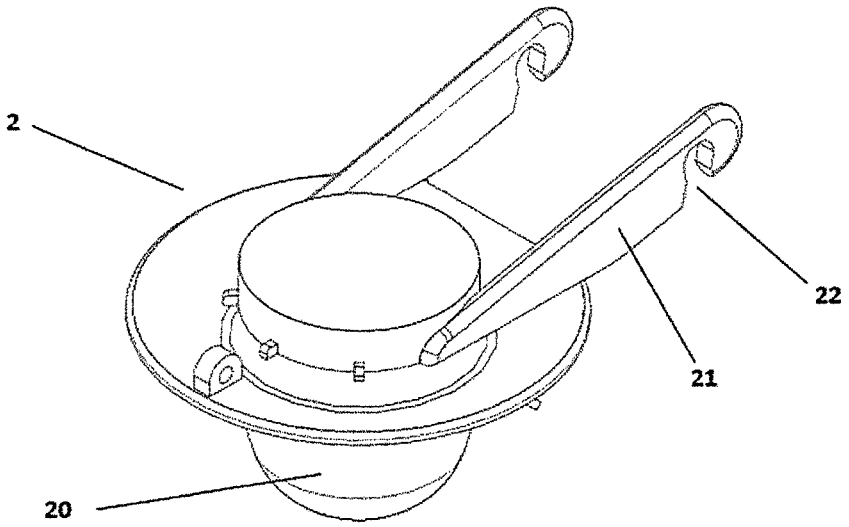
FIG. 2 shows a perspective view of the flapper of the device of a flapper of a flush valve of a toilet tank to a valve base with a lateral overflow pipe, according to an embodiment of the present invention.
Figure 3:
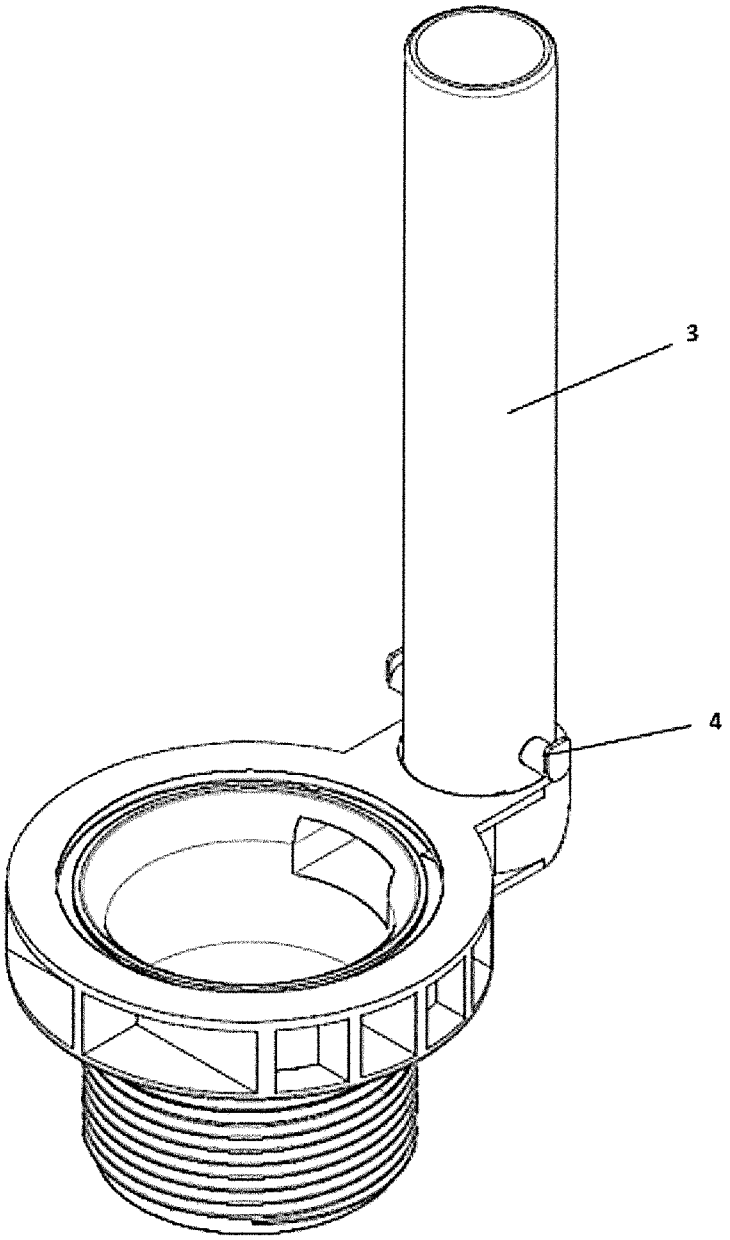
FIG. 3 shows a perspective view of a flush valve provided with a lateral overflow pipe whereon the device for adapting a flapper of a flush valve of a toilet tank to a valve base with a lateral overflow pipe object of the present invention is installed.
Figure 4:
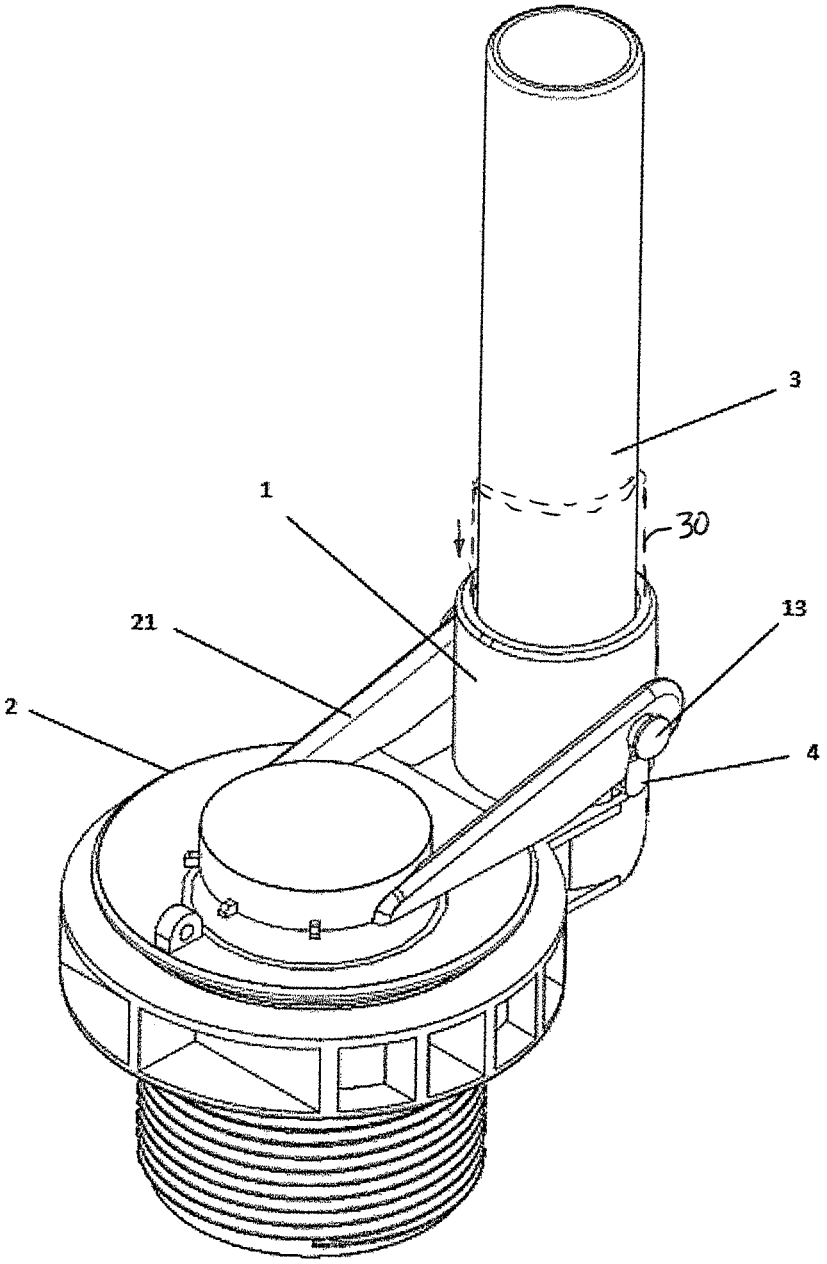
FIG. 4 shows the device for adapting a flapper of a flush valve of a toilet tank to a valve base with a lateral overflow pipe installed in a valve base provided with a lateral overflow pipe, according to an embodiment of the present invention.

Thus, as seen in FIGS. 1 to 4, a possible preferred embodiment of the device for adapting a flapper of a flush valve of a toilet tank to a valve base with a lateral overflow pipe essentially comprises the following elements:

An element (1) for fastening to the overflow pipe, which has a ring shape and which comprises a pair of recesses (10) able to house lugs (4) arranged in the overflow pipe (3). The recesses (10) of the fastening element (1) comprise a divergent mouth (12), in order to enable the automatic positioning of the lug in the recess, and it further comprises a bulge (25) in the inner end thereof which defines a housing (11) of the lugs (4) arranged in the overflow pipe (3). In order for the lug to be able to partially deform the recess before being inserted into the housing (11), the fastening element is made of an elastic material. The fastening element (1) further comprises a pair of lugs (13) arranged in opposite positions in a section of said fastening element (1).

A flapper (2) made up of a flapper body (20) and a pair of arms (21) arranged in the upper portion of said flapper body (20), the end of each arm comprising a housing (22) able to house the lugs (13) of the fastening part (1), whereon the flapper (2) is articulated when a chain joined to the upper portion of the flapper body (20) is pulled.

A supplementary element (30) can be added which is arranged between the fastening element (1) and the overflow pipe (3) and adapts the inner diameter of the fastening element (1) to the outer diameter of the overflow pipe (3).

What is claimed is:

1. A device for adapting a flapper of a flush valve of a toilet tank to a valve base with a lateral overflow pipe, comprising:

a fastening element for fastening to the lateral overflow pipe, which has a ring shape and which comprises:

a pair of recesses house for housing lugs arranged in the lateral overflow pipe, and a pair of lugs arranged in opposite positions in a section of said fastening element; and a flapper comprised of:

a flapper body and a pair of arms arranged in an upper portion of said flapper body, the end of each arm comprising a housing adapted to house the lugs of the fastening part; and wherein the recesses of the fastening element comprise a divergent mouth.

2. The device for adapting a flapper of a flush valve of a toilet tank to a valve base with a lateral overflow pipe, according to claim 1, wherein the fastening element is made of an elastic material.

3. A device for adapting a flapper of a flush valve of a toilet tank to a valve base with a lateral overflow pipe, comprising:

a fastening element for fastening to the lateral overflow pipe, which has a ring shape and which comprises:

a pair of recesses for housing lugs arranged in the lateral overflow pipe, and a pair of lugs arranged in opposite positions in a section of said fastening element; and a flapper comprised of:

a flapper body and a pair of arms arranged in an upper portion of said flapper body, the end of each arm comprising a housing adapted to house the lugs of the fastening part; and wherein each recess of the fastening element comprises a bulge which defines a housing for a lug arranged in the lateral overflow pipe.

4. A device for adapting a flapper of a flush valve of a toilet tank to a valve base with a lateral overflow pipe, comprising:

a fastening element for fastening to the lateral overflow pipe, which has a ring shape and which comprises:

a pair of recesses for housing lugs arranged in the lateral overflow pipe, and a pair of lugs arranged in opposite positions in a section of said fastening element; and a flapper comprised of:

a flapper body and a pair of arms arranged in an upper portion of said flapper body, the end of each arm comprising a housing adapted to house the lugs of the fastening part; and a supplementary part for adapting the inner diameter of the fastening element to the outer diameter of the overflow pipe.

* * * * *